US010916823B1

(12) United States Patent
Hirata

(10) Patent No.: US 10,916,823 B1
(45) Date of Patent: Feb. 9, 2021

(54) BROADBAND TRANSITION FROM STRIPLINE TO SUBSTRATE INTEGRATED WAVEGUIDE

(71) Applicant: BENCHMARK ELECTRONICS, INC., Tempe, AZ (US)

(72) Inventor: Francisco Iwao Hirata, San Diego, CA (US)

(73) Assignee: BENCHMARK ELECTRONICS, INC., Tempe, AZ (US)

( * ) Notice: Subject to any disclaimer, the term of this patent is extended or adjusted under 35 U.S.C. 154(b) by 0 days.

(21) Appl. No.: 16/584,438

(22) Filed: Sep. 26, 2019

(51) Int. Cl.

| | |
|---|---|
| ***H01P 5/107*** | (2006.01) |
| ***H01P 3/12*** | (2006.01) |
| ***H01P 3/08*** | (2006.01) |
| ***H01P 1/208*** | (2006.01) |

(52) U.S. Cl.
CPC ..... *H01P 5/107* (2013.01); *H01P 1/2088* (2013.01); *H01P 3/08* (2013.01); *H01P 3/121* (2013.01)

(58) Field of Classification Search
CPC ..... H01P 5/107; H01P 1/2088; H01P 3/08; H01P 3/121
See application file for complete search history.

(56) References Cited

U.S. PATENT DOCUMENTS 4,070,639 A * 1/1978 Nemit ..... H01P 1/185 333/161
2009/0220240 A1* 9/2009 Abhari ..... H04J 14/0298 398/81
2012/0256707 A1* 10/2012 Leiba ..... H01P 5/107 333/208

* cited by examiner

*Primary Examiner* — Samuel S Outten
(74) *Attorney, Agent, or Firm* — Weiss & Moy, P.C.; Jeffrey D. Moy

(57) ABSTRACT

A device having a stripline to substrate integrated waveguide (SIW) transition structure has a substrate having a top surface and a bottom surface. A first metal ground layer is formed on the top surface of the substrate. A second metal ground layer is formed on the bottom surface of the substrate. A set of metallic vias are used to connect both ground layers. The stripline to SIW transition structure is embedded within the substrate between the first metal ground layer and the second metal ground layer. The stripline to SIW transition structure has a first transmission line embedded within the substrate. An impedance transformer is coupled to one end of the first transmission line. A coupling structure is coupled to the impedance transformer. The coupling structure has a pair of transmission lines. The pair of transmission lines diverge outward and upward from the impedance transformer. An isolation device is used to isolate EM fields from bifurcation of the pair of transmission lines and EM fields located at the end of these transmission lines. At least one terminating via is attached to terminal ends of the pair of transmission lines. Sidewalls are formed on each side of the stripline to SIW transition structure.

20 Claims, 8 Drawing Sheets

BROADBAND TRANSITION FROM STRIPLINE TO SUBSTRATE INTEGRATED WAVEGUIDE

TECHNICAL FIELD

The present application relates generally to the technical field of a substrate integrated waveguide (SIW), and more specifically, to a stripline to SIW transition that converts TEM mode of the stripline to the dominant mode TE10 of the SIW.

BACKGROUND

Substrate integrated waveguide (SIW) technology was initially designed as a low-cost solution for microwave systems. Since its conception in 1998, SIW technology has gained a lot of interest in the research and development of microwave and millimeter components such as filters, antennas, directional couplers, and the like.

As may be seen in FIG. 1, a SIW 100 is formed of a substrate 102. Metal plates 104 and 106 cover the top and bottom surfaces of the substrate 102. Two parallel rows of spaced-apart plated vias/slots (hereinafter vias) 108 connect the metal plate 104 to the metal plate 106. The vias 108 form the sidewalls of the waveguide and define a channel through the substrate 102.

SIW has many advantages over conventional waveguide technology. These advantages include, but are not limited to: easy integration with planar circuitry, low cost, mass production, miniaturization, etc. However, in order to connect active devices to the SIW or to measure Scattering parameters (S parameters), a transition is generally required that converts efficiently TEM (Transverse Electromagnetic) mode from coaxial and stripline or Quasi-TEM mode from microstrip line or Coplanar Waveguide (CPW) to the dominant mode TE10 of the SIW.

While there have been some prior art discussions for stripline to SIW transitions, in these references a stripline taper is used to transform the TEM mode of the stripline to the TE10 mode of the SIW. This requires an extra substrate layer on top of the SIW element for proper operation of the taper. Moreover, an opening window is required on top of the tapered section, which could lead to a possible radiation loss or electromagnetic (EM) interference to nearby transmission lines or circuits.

Therefore, it would be desirable to provide an assembly and method that overcomes the above. The assembly and method would provide a transition from a stripline to SIW not describe in the prior art. The assembly and method would allow an EM signal to be launched between the top and bottom metal layers of the SIW cavity, thereby not requiring an extra substrate layer for proper operation of the transition.

SUMMARY

In accordance with one embodiment, a device having a stripline to substrate integrated waveguide (SIW) transition structure is disclosed. The device has a substrate having a top surface and a bottom surface. A first metal ground layer is formed on the top surface of the substrate. A second metal ground layer is formed on the bottom surface of the substrate. The stripline to SIW transition structure is embedded within the substrate between the first metal ground layer and the second metal ground layer. The stripline to SIW transition structure has a first transmission line embedded within the substrate. An impedance transformer is coupled to one end of the first transmission line. A coupling structure is coupled to the impedance transformer. The coupling structure has a pair of transmission lines. The pair of transmission lines diverge outward and upward from the impedance transformer. An isolation device is used to isolate EM fields from bifurcation of the pair of transmission lines and EM fields located at the end of these transmission lines. At least one terminating via is attached to terminal ends of the pair of transmission lines. Sidewalls are formed on each side of the stripline to substrate integrated waveguide (SIW) transition structure.

In accordance with one embodiment, a device having a stripline to substrate integrated waveguide (SIW) transition is disclosed. The device has a substrate having a first metal ground layer formed on a top surface of the substrate and a second metal ground layer formed on a bottom surface of the substrate. A stripline is provided. The stripline has a first metal trace positioned within the substrate between the first metal ground layer and the second metal ground layer. A first set of sidewalls is provided and arranged on opposing sides of the first metal trace. An impedance transformer is coupled to one end of the first metal trace. A transition area converts transverse electromagnetic (TEM) mode of the stripline to a dominant mode TE10 of a SIW. The transition area comprises a pair of metal traces positioned within the substrate between the first metal ground layer and the second metal ground layer, the pair of metal traces have first ends coupled to the impedance transformer, the pair of metal traces extending out and away from the impedance transformer; an isolation device isolating EM fields from bifurcation of the pair of metal traces and EM fields located at the end of these transmission lines; at least one terminating via attached to terminal ends of the pair of metal traces; and a second set of sidewalls, the second set of sidewalls conforming to an outer perimeter of the pair of metal traces.

In accordance with one embodiment, a device having a stripline to substrate integrated waveguide (SIW) transition structure is disclosed. The device has a substrate having a top surface and a bottom surface. A first metal ground layer is formed on the top surface of the substrate. A second metal ground layer is formed on the bottom surface of the substrate. The stripline to SIW transition structure is embedded within the substrate between the first metal ground layer and the second metal ground layer. The stripline to SIW transition structure comprises: a first transmission line embedded within the substrate; an impedance transformer coupled to one end of the first transmission line; a coupling structure coupled to the impedance transformer, the coupling structure having a pair of transmission lines, the pair of transmission lines diverging outward and upward from the impedance transformer, the pair of transmission lines being symmetrical; an isolation via positioned proximate an area where the coupling structure is coupled to the impedance transformer, the isolation via isolates EM fields from bifurcation of the pair of transmission lines and the ones located at the end of these transmission lines; at least one terminating via attached to terminal ends of the pair of transmission lines; and sidewalls formed on each side of the stripline to substrate integrated waveguide (SIW) transition structure, the sidewalls comprising a plurality of sidewall vias formed through the substrate and coupled to the first metal ground layer and the second metal ground layer, the plurality of sidewall vias arranged in a pair of rows of sidewall vias, the stripline to SIW transition structure position between the pair of rows of sidewall vias.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

The present disclosure provides an assembly having a stripline to SIW transition which may convert a TEM mode of the stripline to the dominant mode TE10 of the SIW. The transition may consist of a stripline, an impedance transformer, a coupling structure, and a plurality of via holes. All the elements may be enclosed by two metallic ground layers, thereby minimizing EM emissions. The compact form may make this transition ideal for single and stacked multilayered SIW filter design. The transition may exhibit broadband behavior with good matching response over the band of interest.

Figure 1:
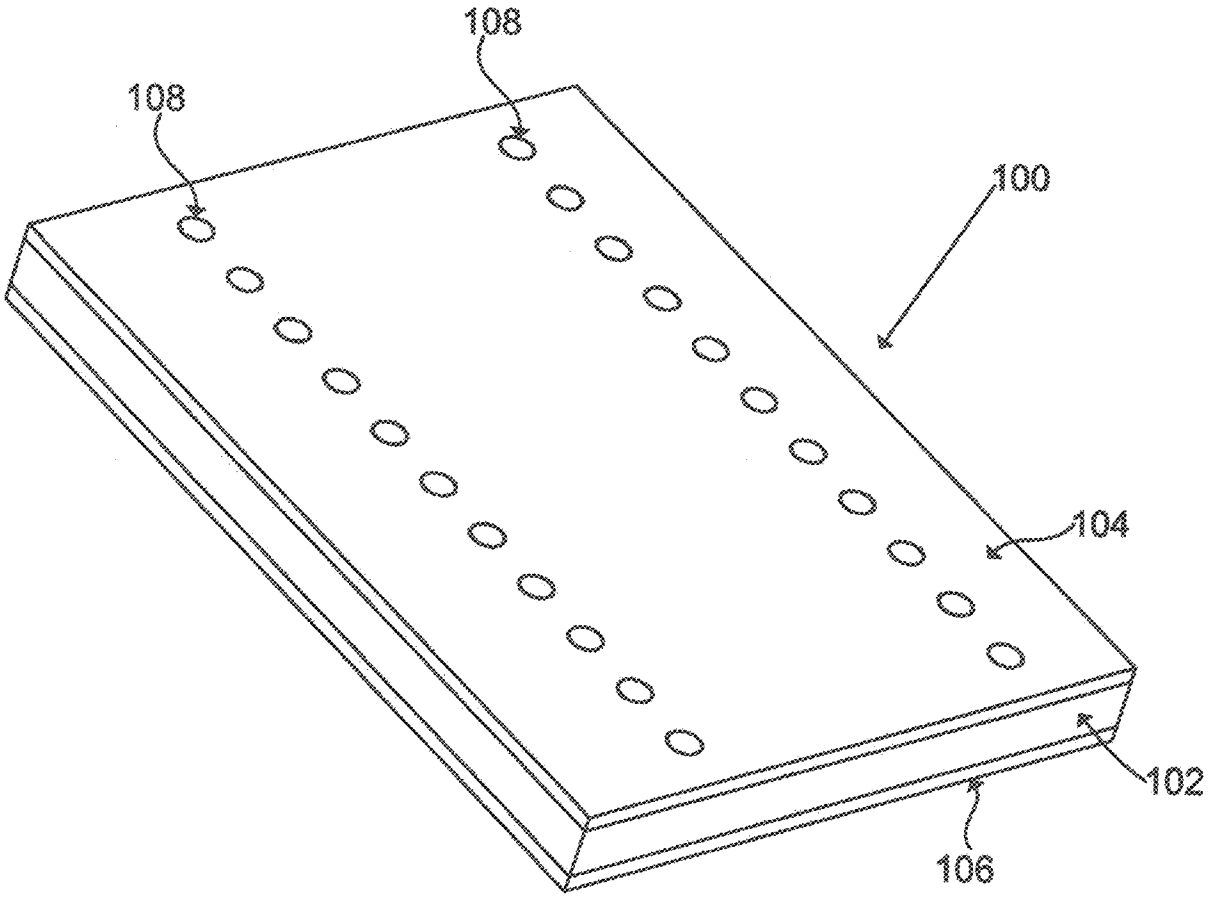
FIG. 1 (Prior Art)
FIG. 1 is an elevated perspective view of a prior art substrate integrated waveguide (SIW)
Figure 2:
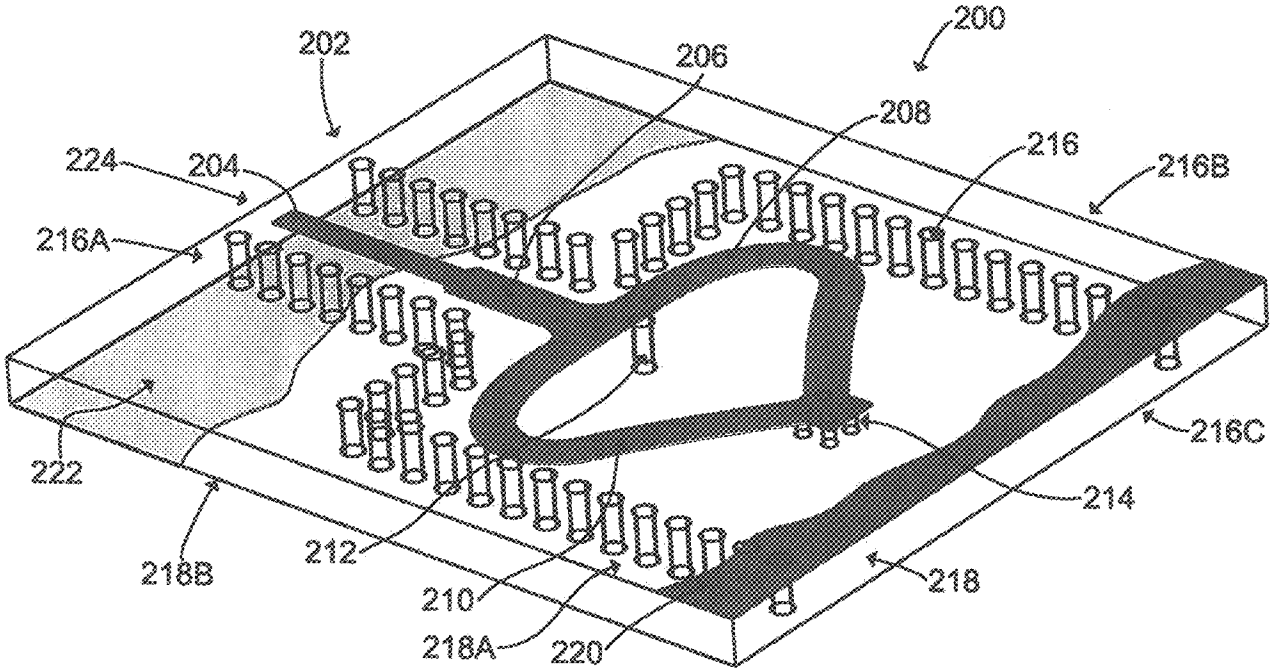
FIG. 2 illustrates a perspective view of an exemplary embodiment of a stripline to SIW transition, in accordance with an aspect of the present application.
Figure 3:
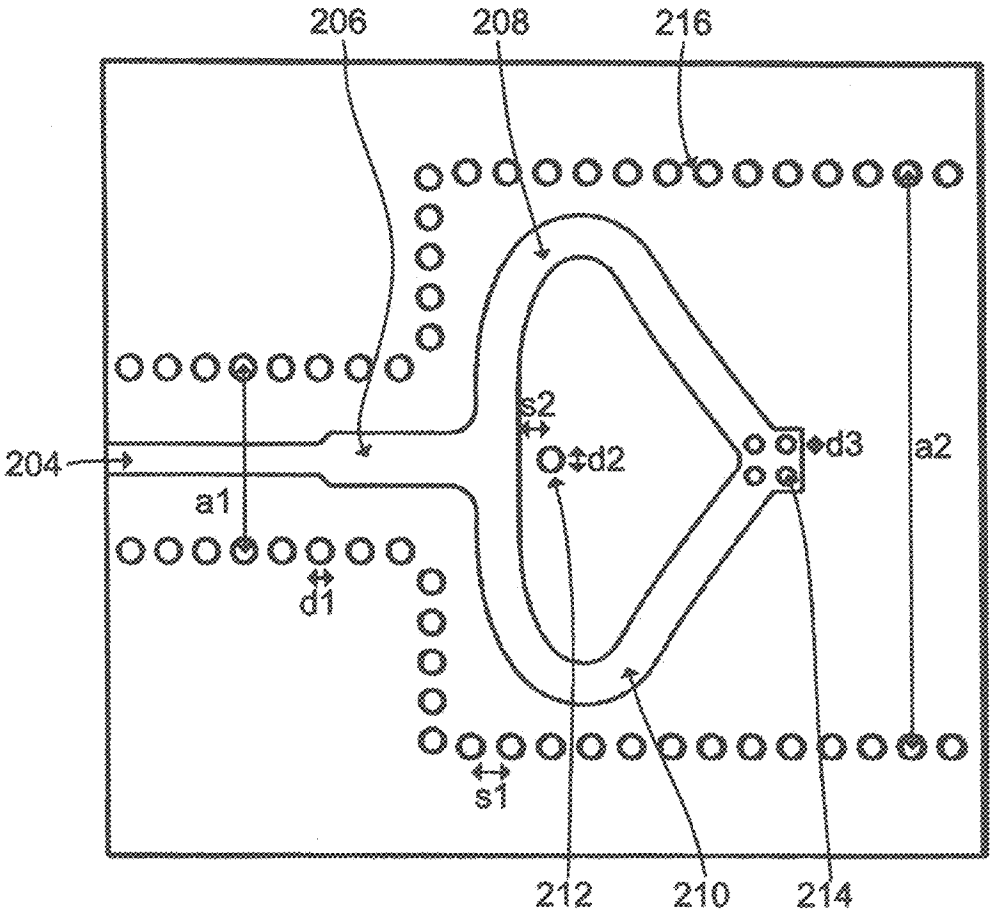
FIG. 3 is a top view of an exemplary embodiment of the stripline to SIW transition of FIG. 2, in accordance with an aspect of the present application.
Figure 4:
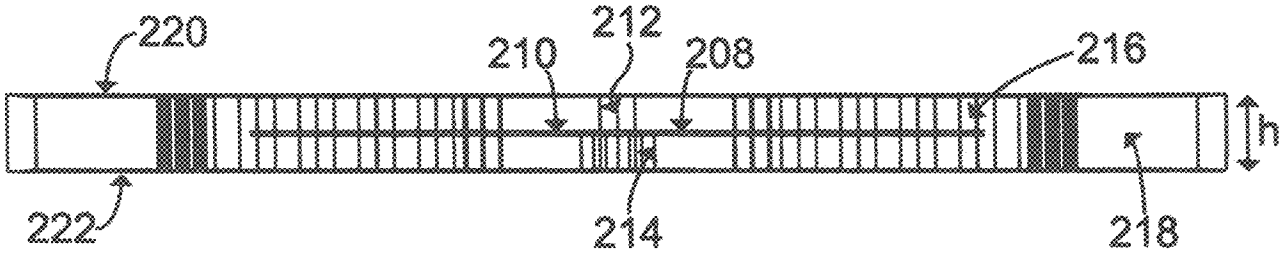
FIG. 4 is a cross sectional view of an exemplary embodiment of the stripline to SIW transition of FIG. 2, in accordance with an aspect of the present invention.

Referring to FIGS. 2-4, a device 200 having a stripline to SW transition 202 may be seen. The stripline to SIW transition 202 may consists of a transmission line 204, an impedance transformer 206, a coupling structure with transmission lines defined by 208 and 210, and a plurality of metalized vias 212, 214, 216 (hereinafter vias 212, 214, 216). The transmission lines 204, 206, 208 and 210 may be formed of conductive metal traces. As may be seen in FIG. 4, the stripline to SIW transition 202 may be formed and supported within a substrate 218. In accordance with one embodiment, the substrate 218 may be a rigid substrate. However, a flexible substrate may be used as well. Metal ground layers 220 and 222 may be formed on a top surface 218A and a bottom surface 218B of the substrate 218. The transmission line 204, the impedance transformer 206, and the transmission lines 208 and 210 may be formed between the two metal ground layers 220 and 222 with the layers of dielectric material of the substrate 218 supporting and insulating the stripline to SIW transition 202 from the two metal layers 220 and 222. The metal layers 220 and 222 may act as ground planes of the stripline to SIW transition 202.

The impedance transformer 206 may be used to couple the impedance from the metal trace forming the transmission line 204 to the metal traces forming the transmission lines 208 and 210. The impedance transformer may be implanted with one impedance step or a plurality of steps. The via 212, with diameter d2, may help to isolate EM fields from bifurcation of the transmission lines 208 and 210, and the EM fields located at the via(s) 214. Passband of the transition can be controlled with the width and length of the transmission lines 208 and 210, and the position of the vias 212 and 214.

The vias 216 form the sidewalls of the stripline and SIW. The vias 216 may be formed through the substrate 218. The via 216 may be plated and coupled to the metal ground layers 220 and 222. The vias 216 may be formed in two rows with one row of vias 216 positioned on each side of the stripline to SIW transition 202. The two rows of vias 216 may follow an outer contour of the stripline to SIW transition 202. In accordance with one embodiment, the stripline and SIW side walls, defined by a plurality of vias 216, can be implemented using metallic slots A first set 216A of each of the two rows of vias 216 may run parallel to the transmission line 204. The first set 216A of the two rows of vias 216 may continue in a parallel manner from the transmission line 204 through the impedance transformer 206. The two rows of vias 216 in the first set 216A may be separated by a distance a1, where the distance may be measured from a centerpoint of corresponding vias 216 across from one another in each of the two rows of the first set 216A of vias 216 as may be seen in FIG. 3.

A second set 216B of each of the two rows of vias 216 may follow the contour of the coupling structure formed of the transmission lines 208 and 210. The second set 216B of each of the two rows of vias 216 may diverge outward and then upward forming an "L"/backwards "L"-configuration with the horizontal leg of the "L"/backwards "L" proximate an area where the coupling structure is coupled to the impedance transformer 206. The vertical members of the "L"/backwards "L" may run parallel to one another. The vertical members of the "L"/backwards "L" of the second set 216B may be separated by a distance a2, where the distance may be measured from a centerpoint of corresponding vias 216 forming the vertical members of the "L"/backwards "L" of the second set 216B of vias 216 as may be seen in FIG. 3.

The TEM cavity may be formed by the transmission line 204, the impedance transformer 206 and the metal ground layers 220 and 222 formed on the top surface 218A and bottom surface 218B respectively on the substrate 218. In the present embodiment, the transmission line 204 may be formed on a side edge and run parallel along a length L of the interior of the substrate 218. The impedance transformer 206 may be attached to a terminal end (end furthest from the side edge) of the transmission line 204.

The transition region between TEM and TE10 modes may be formed by the via 212, the transmission lines 208 and 210 forming the coupling structure, the via(s) 214, and the metal ground layers 220 and 222 formed on the top surface 218A and bottom surface 218B respectively on the substrate 218. The transmission lines 208 and 210 may extend out and away from the impedance transformer 206 and then curve up and back inward. The via 212 may be formed through the substrate 218. The via 212, with diameter d2 and separated from bifurcation by a distance s2, may be plated and coupled to the metal ground layers 220 and 222. The via 212 may be positioned within an interior perimeter of the coupling structure formed by the transmission lines 208 and 210. In accordance with one embodiment, the via 212 may be aligned with an area where the transmission lines 208 and 210 interconnect with the impedance transformer 206.

The via(s)214 may be formed through the substrate 218. The via(s)214 may be plated and coupled to the metal ground layers 220 and 222. The via(s) 214 may be formed at the terminal ends of the transmission lines 208 and 210. In the present embodiment, the terminal ends of the transmission lines 208 and 210 connect forming an enclosed coupling structure. In this embodiment, the enclosed coupling structure formed by the transmission lines 208 and 210 may be shaped similar to a heart/diamond. However, this shape is shown as an example and should not be seen in a limiting manner. The transmission lines 208 and 210 may be terminated in a short circuit using the vias 214. In the present embodiment, an array of vias 214 may be seen. The vias 214 may be formed in an array having a diameter d3 across the array as may be seen in FIG. 3. While FIG. 3 shows the vias 214 in a 2×2 array, this is shown as one example and should not be seen in a limiting manner. In accordance with one embodiment, the transmission lines 208 and 210 may come together and be terminated in a short circuit with a single via 214. In this embodiment, the single via 214 may be of considerable radius. In both cases, dimensions of the vias 214 may be dictated by the design rules.

While the present embodiment shows the transmission lines 208 and 210 may be short circuited to form an enclosed coupling structure, the transmission lines 208 and 210 can be separated. In this embodiment, each transmission lines 208 and 210 may terminate at a respective via 214.

In the present embodiment, the transmission lines 208 and 210 in FIGS. 2 and 3 may be seen as being symmetrical. However, the transmission lines 208 and 210 can also be implemented in an asymmetrical way. However, if the transmission lines 208 and 210 are implemented in an asymmetrical way, both transmission lines 208 and 210 should be approximately the same length.

The TE10 region from the SIW may be defined by the separation distance a2, the dimeter d1 of the vias 216, and the pitch s1 of the vias 216. The pitch s1 may be the distance between centerpoints of adjacent vias 216 forming the vertical members of the "L"/backwards "L" of the second set 216B as may be seen in FIG. 3. The end of the SIW cavity 216C can be connected to another component such as a SIW filter, SIW directional coupler, etc.

The stripline 224 may be designed to match the impedance of the system, which in accordance with the present embodiment may be 50 Ohms. The stripline 224 may consists of the transmission line 204, sandwiched by the dielectric material of the substrate 218 and the two metal layers 220 and 222 forming ground planes.

Parallel plate mode may be suppressed by the first set 216A of the vias 216 running parallel to the transmission line 204 placed at a distance a1. The distance a1 (see FIG. 2) may be approximately 3 to 5 times the width of the transmission line 204. The input of the stripline 224 can be easily interconnected with SMT technology by using a small via or routed to the next layer (or layers) by using blind or buried vias.

Figure 5:
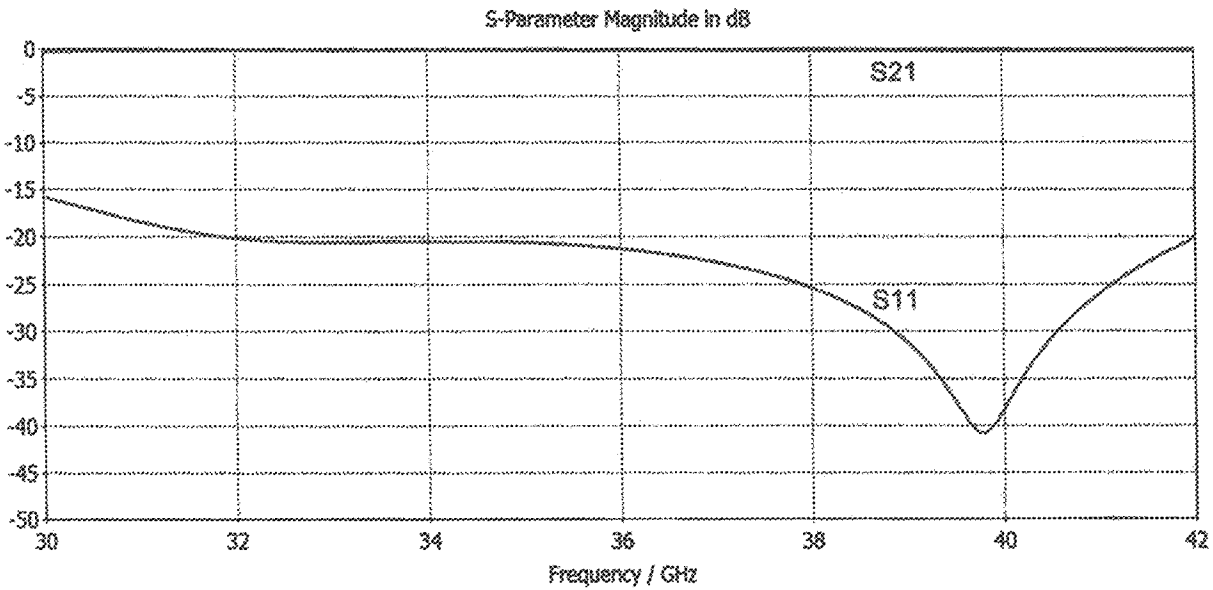
FIG. 5 is a graph showing an exemplary embodiment of a simulation result of the stripline to SIW transition of FIG. 2 for the 28 GHz 5G band, in accordance with an aspect of the present invention.
Figure 6:
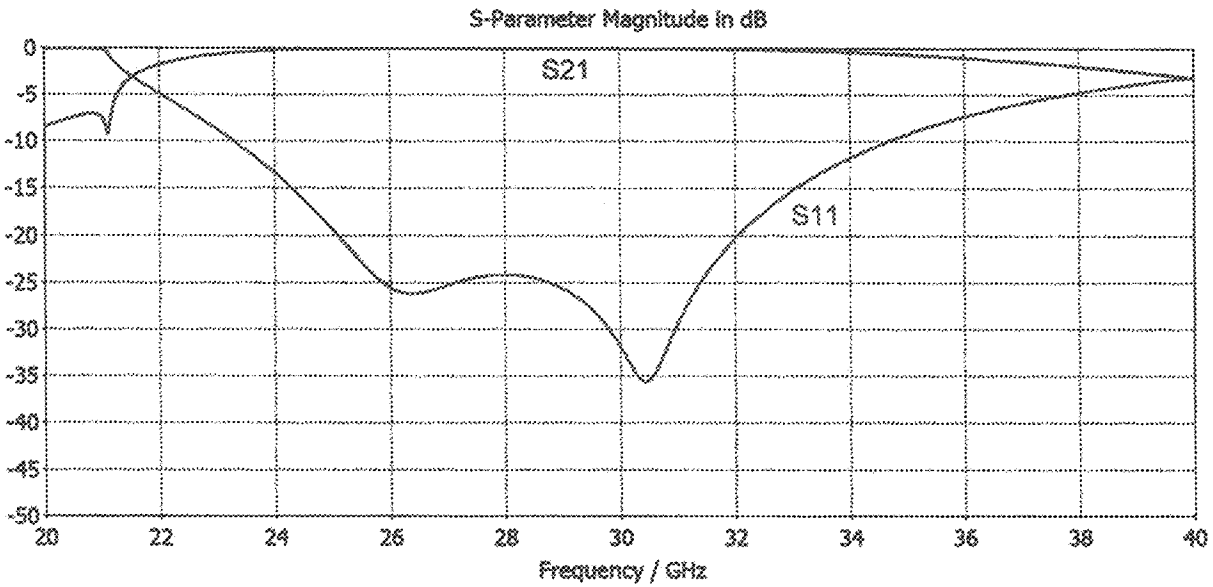
FIG. 6 is a graph showing an exemplary embodiment of a simulation result of the stripline to SIW transition of FIG. 2 for the 37 and 39 GHz 5G bands, in accordance with an aspect of the present invention.

Referring to FIGS. 5 and 6, graphs showing simulated results of the stripline to SIW transition 202 may be seen. The graphs show simulated results covering the 28, 37 and 39 GHz 5G frequency bands. The simulated results were obtained using CST Studio Suite 2018 with the following substrate parameters: LCP (Liquid Crystal Polymer) substrate with a dielectric constant of 2.9, loss tangent of 0.002, and substrate height h of 0.0147". Parameters a1, a2, d1, d2, d3, s1, and s2 are computed according to the required return loss and desired frequency band of operation.

Figure 7:
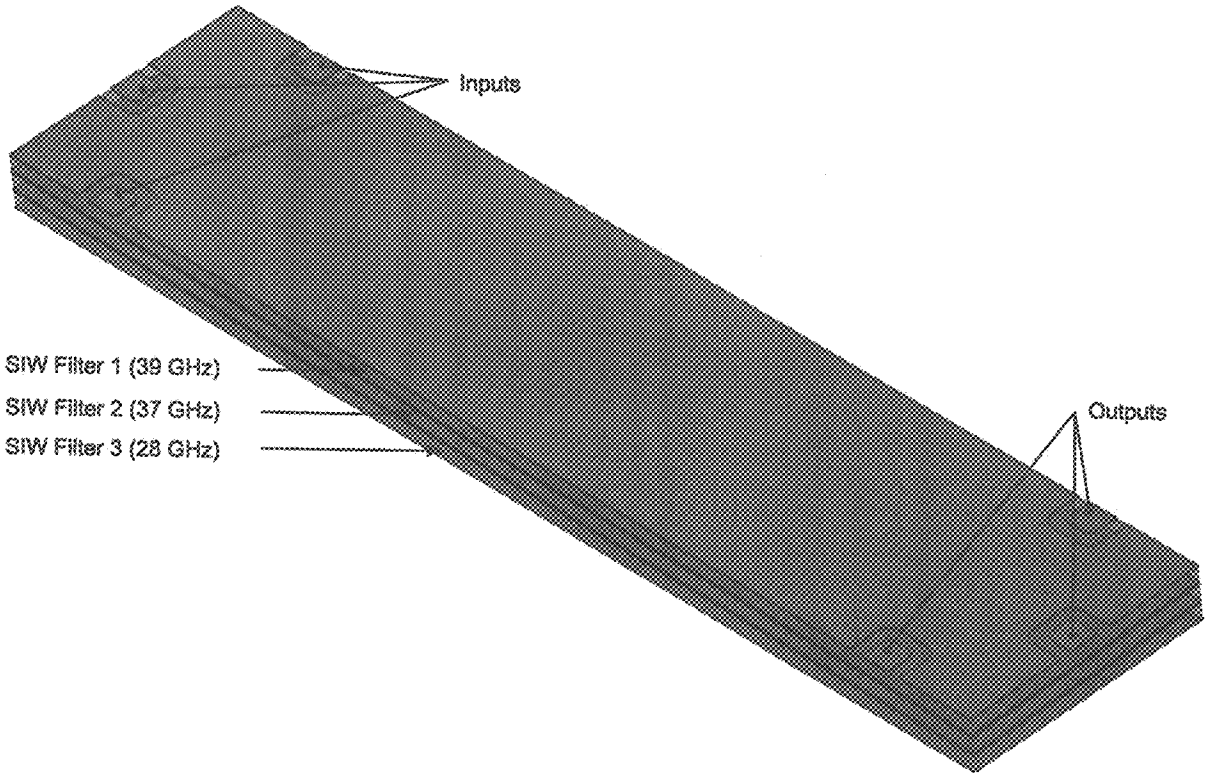
FIG. 7 is a bottom view of an exemplary embodiment of stacked multilayered SIW filters for 50 bands, in accordance with an aspect of the present invention.

FIG. 7 shows a stacked multilayered SIW filters for 5G frequency bands. In FIG. 7, each SIW filter uses a transition from FIG. 2-4. The parameters of the transition and SIW filters are adjusted according to the desired frequency band of operation.

Figure 8:
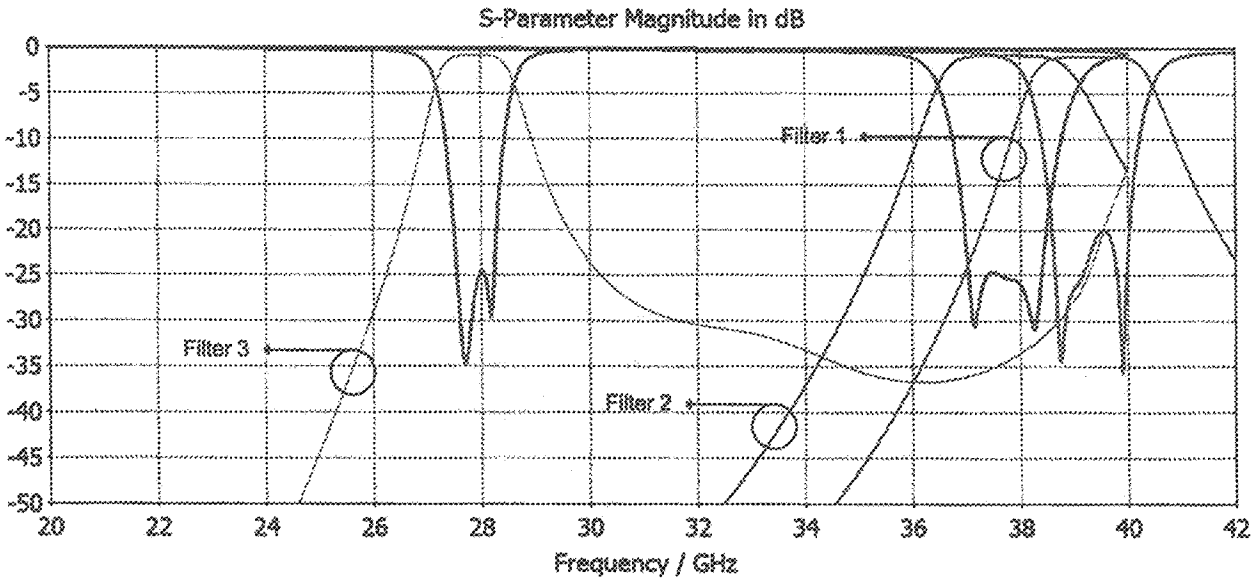
FIG. 8 is a graph showing a simulation result of the stacked multilayered SIW filters for 5G bands shown in FIG. 7, in accordance with an aspect of the present invention.

FIG. 8 shows simulated results for individual filters.

The present invention discloses a stripline to SIW transition 202 which converts TEM mode of the stripline 224 to the dominant mode TE10 of the SIW. The stripline to SIW transition 202 consists of the transmission line 204, the impedance transformer 206, the coupling structure with transmission lines defined by 208 and 210, and the plurality of vias 212, 214, 216. All the elements are enclosed by the metal ground layers 220 and 222, thus minimizing EM emissions. This compact form makes the stripline to SIW transition 202 ideal for single and stacked multilayered SIW filter design. The stripline to SIW transition 202 may exhibit broadband behavior with good matching response over the frequency band of interest.

The foregoing description is illustrative of particular embodiments of the application, but is not meant to be a limitation upon the practice thereof. The following claims, including all equivalents thereof, are intended to define the scope of the application.

What is claimed is:

1. A device having a stripline to substrate integrated waveguide (SW) transition structure comprising:

a substrate having a top surface and a bottom surface;

a first metal ground layer formed on the top surface of the substrate;

a second metal ground layer formed on the bottom surface of the substrate; and the stripline to SIW transition structure embedded within the substrate between the first metal ground layer and the second metal ground layer, wherein the stripline to SIW transition structure comprises:

a first transmission line embedded within the substrate;

an impedance transformer coupled to one end of the first transmission line;

a coupling structure coupled to the impedance transformer, the coupling structure having a pair of transmission lines, the pair of transmission lines diverging outward and upward from the impedance transformer;

an isolation device isolating electromagnetic fields from bifurcation of the pair of transmission lines and EM fields located at the end of these transmission lines;

at least one terminating via attached to terminal ends of the pair of transmission lines; and sidewalls formed on each side of the stripline to substrate integrated waveguide (SIW) transition structure.

2. The device having a stripline to SIW transition structure in accordance with claim 1, wherein the sidewalls a plurality of sidewall vias formed through the substrate and coupled to the first metal ground layer and the second metal ground layer, the plurality of sidewall vias arranged in a pair of rows of sidewall vias, the stripline to SIW transition structure position between the pair of rows of sidewall vias.

3. The device having a stripline to SIW transition structure in accordance with claim 2, wherein the pair of rows of sidewall vias comprises:

a first set of the pair of rows of sidewall vias running parallel to the first transmission line; and a second set of the pair of rows of sidewall vias, the second set of the pair of rows of sidewall vias forming a pair of "L" members, horizontal legs of the pair of "L" members proximate an area where the pair of transmission lines are coupled to the impedance transformer, vertical legs of the pair of "L" members running parallel to one another.

4. The device having a stripline to SIW transition structure in accordance with claim 3, wherein the first set of the pair of rows are separated by a distance 3 to 5 times a width of the first transmission line.

5. The device having a stripline to SIW transition structure in accordance with claim 1, wherein the pair of transmission lines are terminated in a short circuit at the at least one terminating via.

6. The device having a stripline to SIW transition structure in accordance with claim 5, wherein the at least one terminating via is an array of terminating vias.

7. The device having a stripline to SIW transition structure in accordance with claim 1, wherein the isolation device is an isolation via positioned proximate an area where the pair of transmission lines are coupled to the impedance transformer.

8. The device having a stripline to SIW transition structure in accordance with claim 1, wherein the isolation device is an isolation via positioned proximate and aligned with an area where the pair of transmission lines are coupled to the impedance transformer and aligned with an intersection.

9. The device having a stripline to SIW transition structure in accordance with claim 1, wherein the pair of transmission lines are arranged symmetrically.

10. The device having a stripline to SIW transition structure in accordance with claim 1, wherein the substrate is a rigid substrate.

11. A device having a stripline to substrate integrated waveguide (SIW) transition comprising:

a substrate having a first metal ground layer formed on a top surface of the substrate and a second metal ground layer formed on a bottom surface of the substrate;

a stripline, the stripline comprising:

a first metal trace positioned within the substrate between the first metal ground layer and the second metal ground layer;

a first set of sidewalls, the first set of sidewalls arranged on opposing sides of the first metal trace;

an impedance transformer, the impedance transformer coupled to one end of the first metal trace; and a transition area converting transverse electromagnetic (TEM) mode of the stripline to a dominant mode TE10 of a SIW, the transition area comprising:

a pair of metal traces positioned within the substrate between the first metal ground layer and the second metal ground layer, the pair of metal traces have first ends coupled to the impedance transformer, the pair of metal traces extending out and away from the impedance transformer;

an isolation device isolating EM fields from bifurcation of the pair of metal traces and EM fields located at the end of these metal traces;

at least one terminating via attached to terminal ends of the pair of metal traces; and a second set of sidewalls, the second set of sidewalls conforming to an outer perimeter of the pair of metal traces.

12. The device of claim 11, wherein the first set of side walls comprises a first pair of rows of sidewall vias running parallel to the first transmission line.

13. The device of claim 12, wherein the second set of side walls comprises a second pair of rows of sidewall vias, the second pair of rows of sidewall vias forming a pair of "L" members, horizontal legs of the pair of "L" members proximate an area where the pair of metal traces are coupled to the impedance transformer, vertical legs of the pair of "L" members running parallel to one another.

14. The device of claim 12, wherein the first pair of rows of sidewall vias are separated by a distance 3 to 5 times a width of the first metal trace.

15. The device of claim 11, wherein the isolation device is an isolation via positioned proximate an area where the pair of metal traces are coupled to the impedance transformer.

16. The device of claim 11, wherein the pair of metal traces are terminated in a short circuit at the at least one terminating via.

17. The device of claim 11, wherein the at least one terminating via is an array of terminating vias.

18. The device of claim 11, wherein the pair of metal traces are arranged symmetrically.

19. A device having a stripline to substrate integrated waveguide (SIW) transition structure comprising:

a substrate having a top surface and a bottom surface;

a first metal ground layer formed on the top surface of the substrate;

a second metal ground layer formed on the bottom surface of the substrate; and the stripline to SIW transition structure embedded within the substrate between the first metal ground layer and the second metal ground layer, wherein the stripline to SIW transition structure comprises:

a first transmission line embedded within the substrate;

an impedance transformer coupled to one end of the first transmission line;

a coupling structure coupled to the impedance transformer, the coupling structure having a pair of transmission lines, the pair of transmission lines diverging outward and upward from the impedance transformer, the pair of transmission lines being symmetrical;

an isolation via positioned proximate an area where the coupling structure is coupled to the impedance transformer, the isolation via isolating EM fields from bifurcation of the pair of transmission lines and EM fields located at the end of these transmission lines;

at least one terminating via attached to terminal ends of the pair of transmission lines; and sidewalls formed on each side of the stripline to substrate integrated waveguide (SIW) transition structure, the sidewalls comprising a plurality of sidewall vias formed through the substrate and coupled to the first metal ground layer and the second metal ground layer, the plurality of sidewall vias arranged in a pair of rows of sidewall vias, the stripline to SW transition structure position between the pair of rows of sidewall vias.

20. The device having a stripline to SIW transition structure in accordance with claim 19, wherein the pair of rows of sidewall vias comprises:

a first set of the pair of rows of sidewall vias running parallel to the first transmission line, the first set of the pair of rows of sidewall vias separated by a distance 3 to 5 times a width of the first transmission line; and a second set of the pair of rows of sidewall vias, the second set of the pair of rows of sidewall vias forming a pair of "L" members, horizontal legs of the pair of "L" members proximate an area where the pair of transmission lines are coupled to the impedance transformer, vertical legs of the pair of "L" members running parallel to one another.

* * * * *